United States Patent [19]

Huizenga

[11] 4,115,751

[45] Sep. 19, 1978

[54] THERMOSTAT AND METHOD OF OPERATING SUCH

[75] Inventor: Ronald G. Huizenga, Morrison, Ill.

[73] Assignee: General Electric Company, Fort Wayne, Ind.

[21] Appl. No.: 750,277

[22] Filed: Dec. 13, 1976

[51] Int. Cl.[2] ..... H01H 37/12

[52] U.S. Cl. ..... 337/323; 337/330; 337/331

[58] Field of Search ..... 337/307, 311, 308, 312, 337/309, 310, 313, 323, 330, 331, 114, 115, 116; 200/81.9 HG, 153 V

[56] References Cited

U.S. PATENT DOCUMENTS

| | | | |
|---|---|---|---|
| 1,676,920 | 7/1928 | Phelan et al. | 337/373 |
| 1,948,339 | 2/1934 | Doeg | 337/331 X |
| 1,960,856 | 5/1934 | Stacey | 337/331 X |
| 2,353,498 | 7/1944 | Perry | 337/114 X |
| 2,506,623 | 5/1950 | Williams | 337/307 X |
| 2,596,657 | 5/1952 | Crum | 337/339 |
| 3,046,375 | 7/1962 | Houser | 337/337 |
| 3,993,120 | 11/1976 | Iberg et al. | 337/331 X |

*Primary Examiner*—George Harris
*Attorney, Agent, or Firm*—Joseph E. Papin

[57] ABSTRACT

A thermostat for regulating temperature of a space. The thermostat has a pair of means selectively manually movable therein within a predetermined range of temperature settings for setting a selected temperature of the space. Means mounted in lost motion engagement between the setting means is operable generally in response to the selective manual movement of one of the setting means toward a temperature setting defining the selected temperature for driving the other of the setting means toward a temperature setting predeterminately displaced from that of the one setting means within the predetermined temperature range.

A method of operating a thermostat is also disclosed.

23 Claims, 4 Drawing Figures

THERMOSTAT AND METHOD OF OPERATING SUCH

FIELD OF THE INVENTION

This invention relates generally to temperature responsive control devices and in particular to thermostats and methods of operating such.

BACKGROUND OF THE INVENTION

In the past, various types of dual thermostats have been employed for automatically controlling the operating modes of both a cooling system and a heating system adapted to condition, within a predetermined temperature range, the temperature of a space to which such thermostats were subjected, and of course, in some instances a heat pump was utilized in conjunction with such cooling and heating systems.

Various mechanical schemes have been employed in the past dual thermostats to adjust the positions of the spiral bimetals for effecting control of the cooling and heating systems throughout the aforementioned predetermined temperature range. In one such past dual thermostat, the spiral bimetals were mounted to a pair of posts or axles rotatably supported in a housing of the dual thermostat, and such posts were drivenly connected to a pair of levers having an adjusting member threadedly interconnected therebetween. Adjustment movement of the adjusting member threadedly drove the levers and posts until the desired adjusted position was attained for the spiral bimetals wherein such spiral bimetals were responsive at certain temperatures in the predetermined temperature range to effect the actuation of the switch means pairs respectively carried thereby. Of course, a temperature selecting knob was employed to manually move the adjusting member and urge the spiral bimetals toward positions so as to operate at the set point temperature selected upon the manual movement of the temperature selecting knob.

In another of the past thermostats, the spiral bimetals carrying the switch means pairs were also mounted to the rotatable posts, and the levers were drivingly connected with the posts generally in the same manner as discussed above; however, the levers were provided with a pair of abutments extending toward each other. When one of the levers was manually moved toward a set point position for adjusting the position of its associated spiral bimetal so as to control within the predetermined temperature range the operating mode of the cooling system or heating system associated therewith, the abutment on the one lever engaged the abutment on the other of the levers so as to drive it and its associated bimetal toward a position so that the such associated bimetal would not effect the trip point actuation of the switch means pairs wherein the one of the cooling system and heating system associated therewith was rendered, in effect, nonoperative or disabled.

SUMMARY OF THE INVENTION

Among the several objects of the invention may be noted the provision of an improved thermostat and an improved method of operating a thermostat which overcome at least the disadvantageous features discussed hereinabove, as well as others, with respect to the prior art; the provision of such improved thermostat and method which effect simplistic factory set calibration; the provision of such thermostat which includes a pair of temperature setting indicators with lost motion therebetween; and the provision of such improved thermostat and method wherein the components utilized are simplistic in design, economically manufactured and easily assembled. These as well as other objects and advantageous features of the invention will be in part apparent and in part pointed out hereinafter.

In general, a thermostat is provided in one form of the invention for regulating temperature of a space. The thermostat has a pair of means selectively manually movable therein within a predetermined range of temperature settings for setting a preselected temperature of the space, and means mounted in lost motion engagement between the setting means is operable generally in response to the selective manual movement of one of the setting means toward a temperature setting defining the preselected temperature for driving the other of the setting means toward a temperature setting predeterminately displaced from that of the one setting means.

Further in general, a method is provided in one form of the invention for operating a thermostat adapted to be located in a temperature conditioned space with the thermostat including: a pair of means movable to respective ones of adjusted positions and operable therein for sensing the temperature of the space within a pair of preselected temperature ranges; a pair of means adjustably associated with the sensing means and manually movable to temperature indicating positions within the preselected temperature ranges for setting a preselected temperature of the space; and means connected for lost motion engagement between the setting means, respectively. The method comprises the steps of: adjusting one of the setting means to a temperature indicating position within one of the ranges so as to set the preselected temperature of the space and conjointly moving one of the sensing means to a respective one of its adjusted positions in which the one sensing means operates to sense the preselected temperature of the space; and generally simultaneously driving the other of the setting means through the lost motion engagement means and moving the other of the sensing means to a respective one of its adjusted position so as to prevent its operation in response to the preselected temperature of the space.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting in any manner the scope of the invention.

DETAILED DESCRIPTION OF THE PREFERRED EMBODIMENTS

Figure 1:
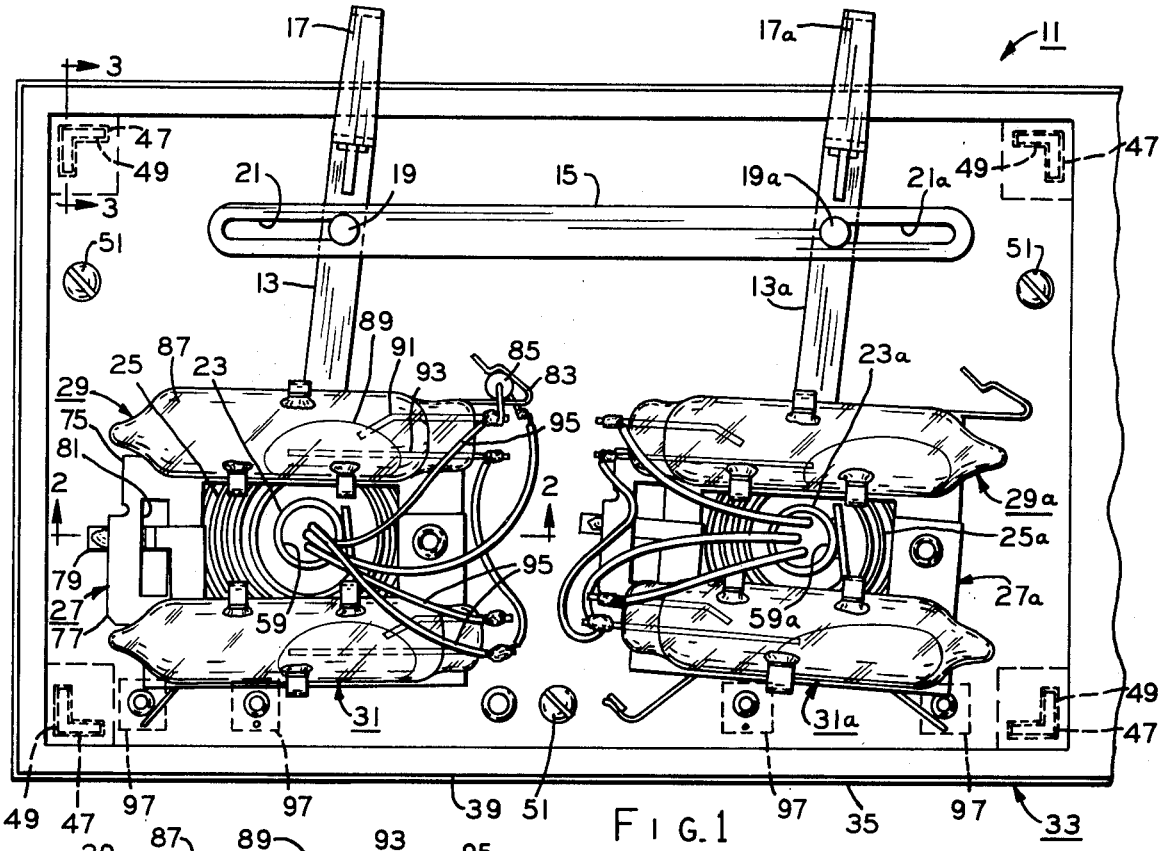
FIG. 1 is a partial plan view showing a thermostat in one form of the invention with a cover of a casing for the thermostat removed therefrom and teaching principles of a method of operating the thermostat also in one form of the invention.

Referring now to the drawings in general, there is illustrated in one form of the invention a thermostat 11 for regulating temperature in a space (not shown) to which the thermostat may be subjected (FIGS. 1-4). Thermostat 11 has a pair of means, such as for instance heating and cooling temperature indicating arms or levers or temperature selectors 13, 13*a*, selectively manually movable therein within a predetermined or preselected range of temperature settings for setting a selected temperature of the space (FIG. 1). Means for effecting lost motion movement between indicating arms or setting means 13, 13*a* includes means, such as a lost motion strut or connecting link 15, or the like for instance for connection in lost motion engagement between the indicating arm, and the connection means or connecting link is operable generally in response to the selective manual movement of one of indicating arms 13, 13*a* toward a temperature setting comprising or defining the selected or preselected temperature for driving the other of indicating arms 13, 13*a* toward a temperature setting predeterminately displaced from that of the one indicating arm (FIG. 1).

More particularly and with specific reference to FIG. 1, indicating arms 13, 13*a* are rotatably or pivotally mounted in thermostat 11, as described in detail hereinafter, and include free ends 17, 17*a* to which an operator or manual force may be applied to effect the rotational or pivotal movement of the indicating arms to the selected temperature setting within the predetermined temperature range. A pair of abutment means, such as studs 19, 19*a* or the like, are respectively provided on indicating arms 13, 13*a* generally adjacent free ends 17, 17*a* for engagement with connecting link 15. Connecting link 15 includes a pair of spaced apart slots or slot means 21, 21*a* in which studs or abutment means 19, 19*a* are slidably received so as to comprise a pair of lost motion connections between the connecting link and indicating arms 13, 13*a*. In this manner, an operator applied force on one of indicating arms 13, 13*a* pivotally drives it so as to move or slide one of the studs 19, 19*a* or within or through one of slots 21, 21*a* into driving or lost motion engagement with connecting link 15, and thereafter the other of slots 21, 21*a* is moved or slid on the other of studs 19, 19*a* into driving or lost motion engagement therewith.

Of course, slots 21, 21*a* each include a pair of opposite abutment ends or end portions arranged to abut with studs 19, 19*a* movable therebetween within the slots, respectively. With connecting link 15 so engaged with studs 19, 19*a*, the one of the indicating arms 13, 13*a* may be moved to its selected temperature setting in response to the manually applied force thereon, and the other of the indicating arms 13, 13*a* is conjointly movable therewith toward its temperature setting which is predeterminately displaced from the selected temperature setting within the predetermined temperature range, as previously mentioned.

Figure 2:
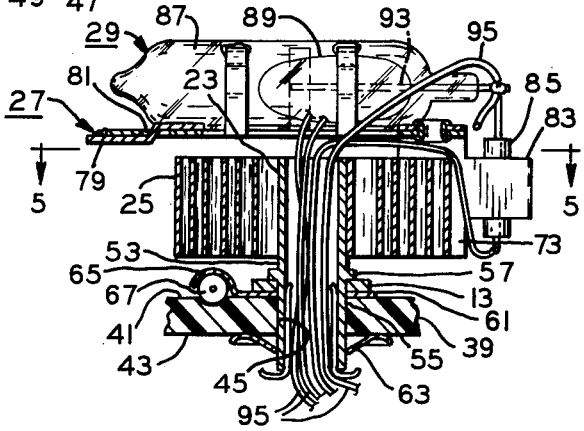
FIGS. 2, 3 and 4 are enlarged partial sectional views taken along lines 2—2, 3—3, and 4—4 of FIG. 1, respectively.

As shown in FIGS. 1 and 2, indicating arms 13, 13*a* are drivingly associated with a pair of rotatable members such as posts or axles 23 for instance, 23*a* to which are attached a pair of means, such as sensing means or bimetal elements 25, 25*a* which carry brackets or cradles 27, 27*a* for supporting switch means pairs 29, 31 and 29*a*, 31*a* respectively; however, since the posts, bimetal elements, cradles and switch means are identical, only those associated with indicating arm 13 will be described in detail hereinafter for the sake of brevity, and the corresponding parts of such components associated with indicating arm 13*a* will be designated by the letter "*a*" when reference is made thereto hereinafter.

Figure 3:
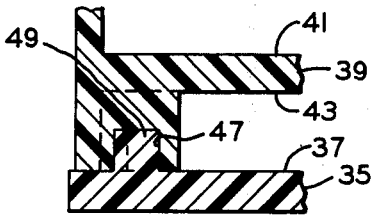

As shown in FIGS. 1 and 3, thermostat 11 is provided with a casing 33 having a plurality of separable casing members releasably retained against displacement from each other by suitable means, the casing members including a base member 35 having a generally planar upper face 37, an intermediate member 39 carried on the base member spaced adjacent its face 37 and having upper and lower generally planar faces 41, 43, and a cover member (not shown) carried on the intermediate member spaced adjacent its upper face 41 and containing at least temperature setting indicia for association with indicating arms 13, 13*a*. As also shown in FIG. 2, a pair of laterally spaced apart openings 45, 45*a* are provided through casing intermediate member 39 between its upper and lower faces 41, 43 for rotatably receiving or mounting posts 23, 23*a*, respectively. A plurality of guide or positioning slots or apertures 47 are provided in intermediate casing member 39 (generally at the corners thereof for instance) adjacent lower face 43 thereof, and a plurality of extension means, such as bosses 49 or the like, are integrally provided on casing base member extending from upper face 37 thereof so as to be received in guiding and positioning engagement with the guide apertures when the casing intermediate and base members are assembled together, FIG. 3. Suitable means, such as a plurality of screws 51 for instance, may be releasably secured between the intermediate and base casing members so as to releasably maintain them against separation or displacement from their assembled positions with respect to each other, and screws 51 may also be utilized as electrical terminals for thermostat 11, FIG. 1.

Means, such as post 23 as shown in FIG. 2, is rotatably disposed in thermostat 11 for mounting both bimetal element 25 and indicating arm 13, and the post or mounting means includes stepped cylindric sections or portions 53, 55 having a generally annular shoulder, such as abutment or bearing surface 57, therebetween with a lead receiving bore 59 extending through the cylindric sections. A pivoted end 60 of indicating arm 13, which may be bifurcated if desired, is disposed in gripping engagement about cylindric section 55 of post 23 between shoulder 57 thereof and a washer-like tab or bearing 61 through which cylindric section 55 extends. Bearing 61 is disposed on upper face 41 of intermediate casing member 39 generally about opening 45 therein, and cylindric section 55 of post 23 is rotatably disposed in the opening extending past lower face 43 of the intermediate casing member. Retaining means, such as a spring washer 63 or the like for instance, is slidably or rotatably received in engagement with lower face 43 of intermediate casing member 39 about opening 45 therein and in resilient wedging or releasable engagement with the lower end portion of cylindric section 55 of post 23 thereby to maintain the post against displacement movement generally axially of the opening. Bearing 61 is provided with a tab portion 65 extending therefrom, and a heater, such as a resistor 67 or the like for instance, is disposed or positioned between the tab portion and upper face 41 of intermediate casing member 39 generally adjacent bimetal element 25.

Figure 4:
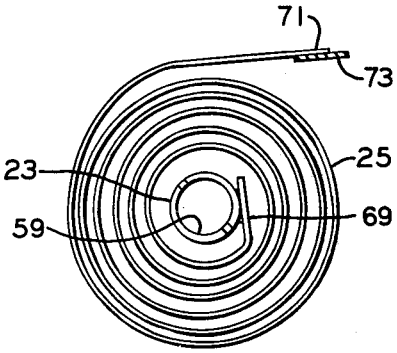

Means, such as bimetal element 25, is mounted in thermostat 11 so as to be conjointly movable with indicating arm 13 and post 23 toward respective ones of adjusted positions and is operable generally in the adjusted positions for sensing the temperature of the space (not shown) in which the thermostat may be located, FIg. 4. Bimetal element or sensing means 25 comprises a strip of bimetal material of any suitable type wound or otherwise formed or deformed into a permanent generally spiral shape or configuration and having a pair of generally spaced radially inner and outer ends 69, 71. Inner end 69 is attached by suitable means, such as a spot weld for instance (not shown), to cylindric section 53 of post 23 so that an edge of the bimetal element is spaced adjacent and generally parallel to upper face 41 of intermediate casing member 39. Outer end 71 of bimetal element 25 is also attached by suitable means, such a spot weld for instance (not shown), to a depending tab 73 of cradle 27 so that the cradle is conjointly movable with the bimetal element both to its adjusted positions and also in response to temperatures sensed by the bimetal element causing movement thereof when the bimental element is in respective ones of its adjusted portions, as discussed hereinafter.

With reference to FIGS. 1 and 2, cradle 27 is provided for supporting switch means 29, 31 which may be of the well-known single pole, single throw mercury type, for instance, and the switch means are adapted for operation generally between a pair of switching modes at predetermined or preselected trip or switching points, i.e. at predetermined degrees of inclination from the horizontal.

While a particular construction of cradle 27 is illustrated herein and described hereinafter, it is contemplated that other cradles having various other constructions may be utilized within the scope of the invention so as to meet the objects thereof. Cradle 27 has a pair of legs 75, 77 pivotally arranged with each other for respectively mounting or supporting switch means 29, 31, and the legs are movable with repsect to each other toward positions arranged to establish or define the predetermined trip points of the switch means. Legs 75, 77 include a pair of integrally formed means, such as for instance an extension means 79 on one of the legs and a portion of the other of the legs disposed about an opening or slot 81 therein through which at least a part of the extension means protrudes, and the extension means and the portion of the other leg are adapted for fixed interconnection with each other to prevent pivotal displacement of the legs from the arranged positions thereof so as to positively maintain the predetermined trip points of switch means 29, 31. Leg 75 may be provided with an integral bent over tab 83 for carrying a resistor or heat anticipator 85. If a more detailed discussion of the construction and details of operation of supporting means or cradle 27 is desired, reference may be had to the Dann. W. Denny application Ser. No. 750,279 filed Dec. 13, 1976.

Thermostat 11 is provided with an electrical circuit (not shown) for controlling the operations or operating modes of a cooling system and a heating system which function to condition the space in which the thermostat may be located, as discussed hereinafter. Switch means 29, 31 form a part of the thermostat electrical circuit and are of the mercury type, as previously mentioned, having a glass tube 87 with a globule of mercury 89 movable therein for making and breaking engagement between contact pairs 91, 93 disposed in the tube depending, of course, upon the degree of inclination of the tube from the horizontal, as also previously mentioned. A plurality of circuit leads 95 have one end connected with contact pairs 91, 93 of switch means 29, 31, and the leads extend or are passed through bore 59 of post 23 so that the other ends of the leads are connected with respective ones of a plurality of busses or circuit components (not shown) of thermostat which may be attached by suitable means to lower face 43 of intermediate casing member 39.

While switch means 29, 31 are illustrated and described herein as being of a particular type or construction, it is contemplated that other switch means of various other types of constructions may be utilized within the scope of the invention so as to meet the objects thereof.

With respect to bimetal element **25*a*, it may be noted that resistor 67*a* associated therewith is a cooling anticipator, and resistor 85 associated with bimetal element 25 is omitted with respect to bimetal element 25*a***.

In the operation of thermostat 11 and assuming the operator desires to effect heating of the space (not shown) in which the thermostat may be located, an applied or manual force may be selectively exerted by the operator on heating indicating arm 13 so as to rotate it in a generally clockwise direction, as best seen in FIG. 1, toward the desired or selected temperature setting thereof, say 70° F. for instance, within the predetermined temperature range, Assuming stud 19 of indicating arm 13 to be disposed between the opposite ends of slot 21 in connecting link 15, the stud is conjointly movable with the indicating arm and within the slot relative to or with respect to the connecting link, i.e. with lost motion, into lost motion engagement with an opposite abutment end of the slot on the connecting link. Upon the establishment of the aforementioned lost motion engagement between stud 19 and connecting link 15, the stud then drives the connecting link relative to or with respect to stud **19*a* on indicating arm 13*a*, i.e. with lost motion, so that slot 21*a* slides on stud 19*a* until an opposite abutment end of the slot on the connecting arm is moved into lost motion engagement with stud 19*a*. Upon the establishment of the aforementioned lost motion engagement of connecting link 15 with stud 19*a*, indicating arm 13*a* is conjointly driven or rotated in the clockwise direction, as best seen in FIG. 1, with indicating arm 13 in response to the operator applied force thereon. Of course, as previously mentioned, the lost motion connection or engagement of connecting link 15 between indicating arm 13, 13*a* provides generally about a 5° F. temperature difference between the set points, i.e. the selected temperature settings or temperature indicating positions of the indicating arms, although it is contemplated that other temperature differences between the set points may be utilized within the scope of the invention so as to meet the objects thereof. Therefore, when indicating arm 13 is moved to its set point so that the selected temperature is indicated at 70° F., as previously mentioned, indicating arm 13*a* is driven to a set point temperature of about 75° F. by indicating arm 13 through the lost motion engagements therewith of connecting link 15. It may be noted that if the operator applied force is exerted on cooling indicating arm 13*a*, the lost motion engagement thereof with connecting link 15 as well as its lost motion engagement with indicating arm 13 thereby to effect concerted driving or rotation of the indicating arms is generally reverse to that discussed hereinabove; therefore, for the sake of brevity, the applied force rotation of cooling indicating arm 13*a*** is omitted from this discussion.

The applied force movement of indicating arm 13 to its set point indicating the selected temperature so as to operate thermostat 11 in its heating mode, as discussed above, effects the conjoint rotation of post 23 in intermediate casing member 39, and since bimetal element 25 is carried on the post, the bimetal element is conjointly rotatable therewith to a respective one of its adjusted positions correlated with the set point or selected temperature indicated by indicating arm 13. In this respective one adjusted position of bimetal 25, switch means 29, 31 of cradle 27 carried by the bimetal element are tilted, i.e. provided with a degree of inclination with respect to the horizontal, such that the mercury globules 89 thereof are disposed in circuit making engagement between contacts 91, 93 defining an operating mode of the switch means so as to enable or energize the heating system (not shown) for conditioning or heating the air of the space (not shown) in which thermostat 11 may be located, as discussed hereinafter. Of course, bimetal 25 is also movable in its respective one adjusted position with respect to post 23 so as to generally wind and unwind in the clockwise and counterclockwise directions thereabout in response to the particular temperature of the space sensed by the bimetal element. With the temperature of the space being increased or heating upon the enabling of the heating system, bimetal element 25 expands so as to move or rotate its radially outer end 71 generally in the counterclockwise direction with respect to post 23. This temperature sensing rotation of the bimetal element outer end 71 conjointly rotates or moves cradle 27 and switches 29, 31 thereon, and as the temperature of the space is increased to the selected temperature of 70° F., the switches are tilted or rotated wherein mercury globules 89 thereof are displaced from contacts 91, 93 toward a circuit breaking position defining another operating mode of the switch means thereby to disable or de-energize the heating system and the heat anticipator 85 included therein. With the heating system so de-energized, the temperature of the conditioned air of the space in which thermostat 11 may be located, of course, falls, and at a preselected differential in excess of the selected temperature value, bimetal element 25 will contract to its respective one adjusted position effecting the return conjoint rotation or tilting of cradle 27 and switches 29, 31 therewith. At this time, mercury globules 89 will again return into contact making engagement with contacts 91, 93 of switches 29, 31 thereby to effect re-energization of the heating system so as to again effect an increase in temperature of the conditioned air in the space in which thermostat 11 may be located generally to the selected temperature of 70° F. Of course, this operation of bimetal element 25 and switches 29, 31 associated therewith in order to control the heating system may be cyclically repeated in response to the temperature demands of the space in which thermostat 11 may be located so as to generally maintain the selected temperature for the space.

As previously mentioned, the lost motion engagements of connecting link 15 between indicating arms **13, 13*a* effects the conjoint rotation of cooling indicating arm 13*a* to a temperature setting or set point predeterminately displaced from that of heating indicating arm 13 upon the operator applied force movement thereof to its set point indicating the selected temperature. This conjoint movement or rotation of cooling indicating arm 13*a* effects the driven conjoint rotation therewith of post 23*a*, bimetal element 25*a* carried thereon, and cradle 27*a* and switches 29*a*, 31*a* associated with the bimetal element to an adjusted position thereof so as to tilt the switches wherein they are generally incapacitated or disabled from switching operation even though the bimetal element operates or moves in its adjusted position to sense the temperature of the space in which thermostat 11 may be located. In order words, even though in its adjusted position bimetal element 25*a* senses and operates in response to the temperature of the space in the same manner as discussed above with respect to bimetal element 25, switches 29*a*, 31*a* are tilted to such a degree from the horizontal that mercury globules 89*a* thereof remain in a circuit breaking position displaced from contacts 91*a*, 93*a*** of the switches thereby to maintain the cooling system (not shown) for the space de-energized, as discussed hereinafter.

In the event the operator desires to operate thermostat 11 in its cooling mode, the operator selectively exerts the manual or applied force on cooling indicating arm **13*a* to effect the lost motion engagements of connecting link 15 therewith and with indicating arm 13 so as to conjointly move the indicating arms, as previously mentioned. If indicating arm 13*a* is moved to a set point of about 70° F. indicating the selected temperature, then indicating arm 13 is conjointly driven to a set point of about 65° F. which, of course, is representative of the aforementioned 5° F. differential between the set points of the indicating arms. This applied force movement of cooling indicating arm 13*a* to its set point effects the conjoint rotation therewith of post 23*a* in intermediate casing member 39, and since bimetal element 25*a* is carried on the post, the bimetal element is conjointly rotatable therewith to a respective one of its adjusted positions correlated with the set point temperature of indicating arm 13*a*. In its respective one adjusted position, bimetal 25*a* and its associated switches 29*a*, 31*a* operate generally in the same manner as previously described with respect to bimetal element 25 and switches 29, 31 with the following exceptions. When bimetal element 25*a* is in its respective one adjusted position, switches 29*a*, 31*a* are tilted to an operating mode thereof so that mercury globules 89*a* are disposed in a circuit breaking position displaced from switch contacts 91*a*, 93*a*, to disable or de-energize the cooling system (not shown) for conditioning the air of the space in which thermostat 11 may be located; however, the bimetal element is also movable relative to or with respect to post 23*a* so as to generally wind or unwind in the clockwise and counterclockwise directions thereabout in response to the particular temperature sensed by the bimetal element. Assuming the temperature of the space to increase when the cooling system is so de-energized, bimetal 25*a* expands so as to move or rotate its radially outer end 71*a* generally in the counterclockwise direction with respect to post 23*a*. This temperature sensing rotation of bimetal element outer end 71*a* rotates cradle 27*a* and switches 29*a*, 31*a* thereon so that mercury globules 89*a* are displaced into contact making engagement with contacts 91*a*, 93*a* of the switches in another operating mode thereof thereby to enable or energize the cooling system. Upon such cooling system energization, the temperature of the conditioned air in the space, of course, decreases, and at a preselected differential in excess of the selected temperature value, bimetal element 25*a* will contract to a degree effecting the conjoint return rotation or tilting of cradle 27*a* and switches 29*a*, 31*a* to their respective adjusted positions. At this time, mercury globules 89*a* will again return to the contact breaking positions displaced from contacts 91*a*, 93*a* thereby to effect de-energization of the cooling system so as to again effect the resulting increase in temperature of the conditioned air of the space from the selected temperature of 70° F. Of course, operation of bimetal element 25*a* and switches 29*a*, 31*a* associated therewith in order to control the cooling system may be cyclically repeated in response to the temperature demands of the space in which thermostat 11** may be located so as to generally maintain the selected temperature of the space.

As previously mentioned, the lost motion engagements of connecting link 15 between indicating arms 13, 13*a* effects the conjoint rotation of heating indicating arm 13 to its set point predeterminately displaced from the selected temperature upon the operator applied force movement of indicating arm 13*a*. This conjoint rotation of heating indicating arm 13 effects the driven conjoint rotation of post 23, bimetal element 25 and switches 29, 31 associated therewith so as to tilt the switches toward a position wherein they are generally incapacitated or disabled from switching operation even though the bimetal operates to sense the temperature in the space. For instance, even though bimetal element 25 is temperature responsive, switches 29, 31 are tilted to such a degree from the horizontal that mercury globules 89 thereof remain in a circuit breaking position displaced from contacts 91, 93 of the switches thereby to maintain the heating system for the space de-energized.

From the foregoing, it is now apparent that a novel thermostat 11 and method of operating such are presented meeting the objects and advantages therefor set out hereinbefore, as well as other objects and advantages, and that changes as to the precise arrangements, shapes, details and connections of the constructions illustrated herein by way of example, as well as the precise order of the steps of the method, may be made by those having ordinary skill in the art without departing from the spirit of the invention or the scope of the invention set out by the claims which follow.

What I claim as new and desire to secure by Letters Patent of the United States is:

1. A thermostat for regulating temperature of a space comprising:

(a) a casing including base;

(b) first and second posts rotatably mounted to said base;

(c) first and second bimetal elements adapted for movement to respective ones of adjusted positions in the thermostat and operable generally therein to sense the temperature in the space, said first and second bimetal elements each having a generally spiral configuration with radially inner and outer ends and said radially inner ends being secured to said first and second posts, respectively;

(d) first and second pairs of switches respectively operable generally for energization and de-energization at predetermined trip points thereof;

(e) first and second brackets secured to said outer ends of said bimetal elements and including first and second pairs of legs for supporting said first and second switch pairs and said legs of said first and second leg pairs being mounted for pivotal movement with respect to each other toward selected positions so as to establish the respective predetermined trip points of said switches of said first and second switch pairs, respectively;

(f) first and second temperature selectors manually movable in said casing within a predetermined range of temperature settings so as to set selected temperatures for the space and connected with said first and second posts to conjointly rotate them and said first and second bimetal elements to respective ones of the adjusted positions thereof, respectively;

(g) a connecting link disposed between said first and second temperature selectors including first and second spaced apart slots; and (h) first and second abutments on said first and second temperature selectors extending into said first and second slots for lost motion engagement with said connecting link, said connecting link being driven in response to the engagement of one of said first and second abutments therewith to conjointly rotate both one of said first and second temperature selectors and one of said first and second posts so as to move one of said first and second bimetal elements toward a respective one of its adjusted positions maintaining one of said first and second switch pairs de-energized upon the manual movement of the other of said first and second temperature selectors toward a temperature setting defining its selected temperature, and the other of said first and second posts being rotated in response to the manual movement of said other of said first and second temperature selectors to conjointly move the other of said first and second bimetals to a respective one of its adjusted positions so as to effect the energization and de-energization operations of the other of said first and second switch pairs when said other of said first and second bimetals operates in its respective one adjusted position to sense the preselected temperature upon the occurrence thereof in the space.

2. A thermostat for regulating temperature of a space comprising:

(a) a pair of means selectively manually movable in said thermostat within a predetermined range of temperature settings for setting a selected temperature of the space; and (b) means mounted in lost motion engagement between each of said setting means and operable generally in response to the selective manual movement of one of said setting means toward a temperature setting comprising the selected temperature for driving the other of said setting means toward another temperature setting predeterminately displaced from that of said one setting means within the predetermined temperature range.

3. A thermostat as set forth in claim 2 further comprising a pair of means mounted in said thermostat so as to be conjointly movable with said setting means toward adjusted positions and operable generally in the adjusted positions for sensing the temperature of the space, respectively, one of said sensing means being movable toward a respective one of its adjusted positions in which it operates to sense the preselected temperature upon the selective manual movement of said one setting means toward the temperature setting defining the preselected temperature and the other of said sensing means being movable toward a respective one of its adjusted position in which its operation in response to the temperature in the space is generally ineffective when said other setting means is driven to the another predeterminately displaced temperature setting thereof.

4. A thermostat as set forth in claim 3 wherein a heating system and a cooling system are respectively operable to condition the temperature of the space, and further comprising at least a pair of switch means operable generally for energization and de-energization at predetermined trip points thereof so as to control the operations of the heating system and the cooling system and mounted to said sensing means so as to be conjointly movable therewith, one of said switch means being movable between its trip points to effect the energization and de-energization of one of the heating system and the cooling system upon the operation of said one sensing means in its respective one adjusted position to sense the temperature in the space and the other of said switch means maintaining the other of the heating system and the cooling system de-energized when said other setting means is driven to the another predeterminately displaced temperature setting thereof.

5. A thermostat as set forth in claim 2 further comprising a pair of lost motion connections associated with said setting means and said driving means, respectively, said driving means being actuated through one of said lost motion connections in respect to the selective manual movement of said one setting means to effect the other of said lost motiion connections and drive said other setting means to its predeterminately displaced temperature setting.

6. A thermostat as set forth in claim 2 wherein said driving means comprises a connecting link having a pair of spaced apart slots therein, and a pair of abutment means on said setting means movable in said slots for engagement with said connecting link, respectively, one of said abutment means being drivingly engaged with said connecting link upon the selective manual movement of said one setting means to effect conjoint movement of said connecting link therewith and the other of said abutment means being driven by said connecting link to effect the driving of said other setting means to the another predeterminately displaced temperature seting thereof.

7. A thermostat as set forth in claim 3 further comprising a pair of means rotatable in the thermostat for mounting both said sensing means and said setting means, said mounting means being rotated in response to movement of said setting means to effect the conjoint movement therewith of said sensing means to their respective one adjusted positions, respectively.

8. A thermostat as set forth in claim 3 further comprising at least a pair of switching means for actuation generally at preselected trip points, and a pair of means mounted to said sensing means for supporting said at least switching means pair, said supporting means respectively including a pair of means mounted for pivotal movement toward selected positions with respect to each other so as to predetermine the trip points of said at least switching means pair, said at least switching means pair being respectively mounted to one of said pivotal movement means of said pairs thereof, and said pivotal movement means including means for predeterminately limiting the pivotal movement of said pivotal movement means with respect to each other, said limiting means being adapted for fixed interconnection in the selected positions of said pivotal movement means in which the trip points of said at least switching means pair are predetermined, respectively.

9. A thermostat for regulating the operating and nonoperating modes of a heating system and a cooling system to condition the temperature of a space, the thermostat comprising:

(a) a pair of means movable in the thermostat between adjusted positions and operable generally in respective ones of the adjusted positions for sensing temperature in the space, respectively;

(b) at least a pair of means mounted to said sensing means and generally conjointly movable therewith for switching the heating system and the cooling system between the operating and nonoperating modes thereof when said sensing means operate in the respective one adjusted positions thereof to sense the temperature in the space, respectively:

(c) a pair of means selectively manually movable in the thermostat for setting a preselected temperature of the space and adjustably associated with said sensing means so as to conjointly move them toward their respective one adjusted positions, respectively; and (d) means operable generally in response to the selective manual movement of one of said setting means to move one of said sensing means to its respective one adjusted position and for driving the other of said setting means so as to move the other of said sensing means to its respective one adjusted position in which at least one of said switching means of said at least switching means pair maintains one of the heating system and the cooling system in its nonoperating mode, and at least the other of said at least switching means pair being operable to switch the other of the heating system and the cooling system between the operating and nonoperating modes thereof upon the operation of the one sensing means in its respective one adjusted position in response to variances of the temperature in the space from the preselected temperature set by said one setting means upon the selective manual movement thereof.

10. A thermostat responsive to a preselected temperature to effect the operation of a cooling system and a heating system comprising a casing, a pair of means manually movable in the casing within a predetermined range of temperature settings for setting the preselected temperature at which the thermostat is responsive to effect the operation of the cooling system and the heating system, respectively, and means interposed between said setting means and defining a pair of lost motion connections therewith, respectively, for driving one of said setting means toward a temperature setting at which the thermostat is non-responsive to effect the operation of one of the cooling system and the heating system upon the manual movement of the other of said setting means toward a temperature setting defining the preselected temperature at which the thermostat is responsive to effect the operation of the other of the cooling system and the heating system.

11. A method of operating a thermostat adapted to be located in a temperature conditioned space, the thermostat including a pair of means movable to respective ones of adjusted positions and operable therein for sensing the temperature of the space within a preselected temperature range, a pair of means adjustably associated with the sensing means and manually movable to temperature indicating positions within the preselected temperature range for setting a selected temperature of the space, and means connected for lost motion engagement between the setting means, respectively, the method comprising the steps of:

(a) adjusting one of the setting means to a temperature indicating position within the predetermined range so as to set the selected temperature of the space and conjointly moving one of the sensing means to a respective one of its adjusted positions so that the operation of the one sensing means is effective in response to the temperature of the space; and (b) generally simultaneously driving the other of the setting means through the lost motion engagement means and moving the other of the sensing means to a respective one of its adjusted position so that the operation of the other sensing means is ineffective in response to the selected temperature of the space.

12. A thermostat as set forth in claim 10 further comprising a pair of rotatable members mounted in the thermostat and associated with said setting means so as to be rotatably driven in response to the manual movement of said setting means, respectively.

13. A thermostat as set forth in claim 12 further comprising a pair of bimetal elements mounted to said rotatable members so as to be conjointly rotatable therewith and arranged so as to be movable with respect to said rotatable members in response to the temperature of the space in which the thermostat may be located, respectively.

14. A thermostat as set forth in claim 13 further comprising a pair of switch means associated with said bimetal elements so as to be conjointly movable therewith for controlling the operation of the heating system and the cooling system, respectively.

15. A thermostat as set forth in claim 14 further comprising a pair of cradles mounted to said bimetal elements and arranged to support said switch means, respectively.

16. A thermostat as set forth in claim 10 wherein said lost motion connections comprise a pair of slot means in one of said driving means and each of said setting means, and a pair of abutment means on the other of said driving means and said each setting means and movable within said slot means, said slot means and said abutment means being movable with lost motion with respect to each other until said abutment means abut with said driving means in response to the manual movement of one of said one setting means and said other setting means toward the preselected temperature setting thereof, respectively.

17. A thermostat as set forth in claim 16 wherein said slot means each include a pair of opposite end portions arranged to engage with said abutment means, one of said slot means and said abutment means being movable with the lost motion with respect to the other thereof until said abutment means engages one of said opposite end portions of said each slot means, respectively.

18. A thermostat adapted for effecting regulation of temperature in a space in which the thermostat may be located, the thermostat comprising a pair of means for sensing in a plurality of adjusted positions thereof the temperature of the space and movable in respective ones of the adjusted positions of the plurality thereof in response to the temperature of the space sensed thereby, respectively; a pair of switch means associated with said sensing means and conjointly movable therewith for operation between a pair of switching modes thereof, respectively; a pair of means selectively manually movable in the thermostat within a predetermined range of temperature settings for setting a selected temperature of the space and arranged with said sensing means so as to effect the disposition of said sensing means in the respective ones of the adjusted positions thereof correlative with the selected temperature settings of said setting means, respectively; and means for effecting lost motion between said setting means upon the respective selective manual movement thereof, said lost motion effecting means including means for connection between said setting means and arranged in lost motion engagement with at least one of said setting means, said connection means being operable in response to the selective manual movement of one of said at least one setting means and the other of said setting means to the selected temperature setting thereof to effect the movement of the other of said at least one setting means and said other setting means toward another temperature setting predeterminately displaced from the preselected temperature setting of said one of said at least one setting means and said other setting means, and one of said sensing means being disposed in one of the respective ones of the adjusted positions thereof correlative with the another predeterminately displaced temperature setting of said other of said at least one setting means and said other setting means so as to prevent the operation of one of said switch means between its switching modes upon the movement of said one sensing means in response to the temperature of the space sensed by said one sensing means.

19. A thermostat as set forth in claim 18 wherein said lost motion effecting means further includes slot means in one of said connection means and said at least one setting means, and abutment means on the other of said connection means and said at least one setting means and movable within said slot means, one of said slot means and said abutment means being movable with lost motion into engagement with the other thereof in response to the selective manual movement of said one of said at least one setting means and said other setting means to the selected temperature setting thereof so as to effect the movement of the other of said at least one setting means and said other setting means toward the another predeterminately displaced temperature setting thereof.

20. A thermostat as set forth in claim 19 wherein said slot means includes a pair of opposite abutment end portions arranged to engage with said abutment means, said one of said slot means and abutment means being movable with the lost motion with respect to the other thereof until said abutment means engages one of said abutment end portions of said slot means.

21. A thermostat as set forth in claim 18 further comprising a pair of means associated with said sensing means so as to be conjointly movable therewith for supporting said switch means, respectively.

22. A thermostat as set forth in claim 18 further comprising a pair of means rotatably movable in the thermostat and operatively engaged with said setting means for mounting said sensing means, said mounting means being rotatable so as to dispose said sensing means in the respective ones of the adjusted positions thereof in response to the selective manual movement of said setting means, respectively.

23. A thermostat as set forth in claim 18 wherein said sensing means comprise a pair of bimetal elements having generally spiral configurations, and a pair of generally radially spaced inner and outer end portions on said bimetal elements, said inner end portions being associated with said setting means and conjointly movable therewith to effect the disposition of said sensing means in the respective ones of the adjusted positions thereof, and said outer end portions being arranged with said switch means to effect the operation thereof upon the movement of said sensing means in response to the temperature of the space sensed by said sensing means, respectively.

* * * * *

UNITED STATES PATENT AND TRADEMARK OFFICE

CERTIFICATE OF CORRECTION

PATENT NO. : 4,115,751

DATED : September 19, 1978

INVENTOR(S) : Ronald G. Huizenga

It is certified that error appears in the above-identified patent and that said Letters Patent are hereby corrected as shown below:

```
Col.  3, line  8, delete ",";
         line  9, after "instance" insert --,--;
         line 10, delete "arm" and insert --arms--;
         line 35, delete "the";
         line 36, delete "or" (first occurrence);
         line 55, after "bers" insert --,--;
         line 55, delete "for instance," and insert --,--;
         line 55, after "23a" insert --for instance,--;
         line 57, after "carry" insert --a pair of means, such
                  as--;
         line 58, after "27a" insert --or the like for instance,
                  --;
         line 59, after "31a" insert --,--.
Col.  5, line  1, delete "spaced radially" and insert --radially
                  spaced--;
         line 30, delete "repsect" and insert --respect--.
Col. 11, line 18, delete "motiion" and insert --motion--;
         line 33, delete "seting" and insert --setting--.
Col. 12, line  5, delete ":" and insert --;--.
```

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*